US005775175A

United States Patent [19]

Salemno et al.

[11] Patent Number: 5,775,175

[45] Date of Patent: Jul. 7, 1998

[54] DEVICE FOR WINDING A CRANK AND ASSOCIATED METHOD

[76] Inventors: Thomas A. Salemno, 337 Indian Creek Rd., Harleysville, Pa. 19438; William I. Smith, 2801 Stanbridge St., Apt. 807, Norristown, Pa. 19401

[21] Appl. No.: 744,602

[22] Filed: Nov. 7, 1996

Related U.S. Application Data

[63] Continuation-in-part of Ser. No. 689,515, Aug. 12, 1996.

[51] Int. Cl.[6] ..... G05G 1/12

[52] U.S. Cl. ..... 74/545; 74/544

[58] Field of Search ..... 74/545, 546, 547, 74/548, 544; 16/114 R; D8/309

[56] References Cited

U.S. PATENT DOCUMENTS

| | | | |
|---|---|---|---|
| 1,503,349 | 7/1924 | Clay | 74/548 X |
| 1,702,511 | 2/1929 | Karlovick | 74/548 |
| 2,463,971 | 3/1949 | Jackson | 74/547 X |
| 4,674,355 | 6/1987 | Klein | 74/545 X |
| 5,433,565 | 7/1995 | Chan | 74/544 X |
| 5,482,347 | 1/1996 | Clarys et al. | 74/546 X |

FOREIGN PATENT DOCUMENTS

| | | | |
|---|---|---|---|
| 746800 | 6/1933 | France | 74/546 |

*Primary Examiner*—Charles A. Marmor
*Assistant Examiner*—Mary Ann Battista
*Attorney, Agent, or Firm*—LaMorte & Associates P.C.

[57] ABSTRACT

A hand crank device and associated method for winding winches such as those used on flat bed tractor trailers. The hand crank device includes an elongated pin element that is sized to engage the drive shaft of a winch. The pin element is long enough to enter through one hole on the drive shaft, extend across the drive shaft and exit the drive shaft through a second hole on the opposite side. The pin element is affixed to the short arm section of an L-shaped bracket. A handle is affixed to the long arm section of the L-shaped bracket, thereby enabling a torque to be applied to the L-shaped bracket and the pin element affixed to the L-shaped bracket. The torque acting on the pin element is transferred to the drive shaft of the winch, thereby causing the drive shaft to turn and the winch to rewind.

5 Claims, 4 Drawing Sheets

DEVICE FOR WINDING A CRANK AND ASSOCIATED METHOD

CONTINUATION-IN-PART APPLICATION

This application is a Continuation-In-Part of U.S. patent application Ser. No. 08/689,515 entitled DEVICE FOR WINDING A CRANK AND ASSOCIATED METHOD, filed Aug. 12, 1996.

BACKGROUND OF THE INVENTION

1. Field of the Invention

The present invention relates in general to hand cranks used to turn winches. More particularly, the present invention relates to a hand crank device specifically designed to engage strapping winches, such as those used on a flat bed trailer, and rapidly rewind any strapping extending from those winches in an ergonomically efficient manner.

2. Description of the Prior Art

In the prior art there are many different types of winches that are wound by a hand crank. An example of such a winch is shown in U.S. Pat. No. 5,346,153 to Ebey, entitled WINCH STRAP ANCHOR. A common application for such winches is their use on flat bed trailers. Such winches are commonly used to tighten either cables or strapping, thereby enabling cargo to be tied down to the top of the flat bed trailer. Such a prior art application is shown in FIG. 1. In FIG. 1, a flat bed trailer 10 for a tractor trailer is shown. On either side of the trailer are tracks in which are held a plurality of strap winches 14. The strap winches 14 each contain a length of strapping 18 (shown) or cable (not shown) that can be passed over or through the cargo being carried on the flat bed trailer 10. After the strapping 18 is passed over or through the cargo, the strapping 18 is anchored to the opposite side of the flat bed trailer 10 and the strap winches 14 are tightened to bias the strapping 18 toward the trailer bed.

Referring to FIG. 2 a typical configuration for a strapping winch 14 is shown. In such strapping winches, a piece of strapping 18 is anchored to a bobbin shaft 22. The bobbin shaft 22 is joined to a main gear 24 that causes the bobbin shaft 22 to turn when it turns. The main gear 24 engages a drive gear 26 that is joined to a drive shaft 28. As the drive shaft 28 is turned, the drive gear 26 turns, thereby turning the main gear 24 and the bobbin shaft 22. The drive gear 26 is ratcheted so that it can only turn in one direction when the strapping 18 is being tightened. A release lever 30 disengages the ratcheting, thereby enabling the strapping to become slack when ready for removal.

On a typical flat bed trailer, the drive shaft 28 used to turn the drive gear 26 is hollow near its end. A ring of holes 32 are disposed through the hollow end. The holes 32 are sized to receive the pointed end of a long tightening rod 34. The tightening rod 34 enables a large torque to be applied to the drive shaft 28, thereby ensuring that the winch 14 pulls taut on the strapping 18 holding down the cargo. The problem with the prior art configuration shown is that the long tightening rod 34 can often only be turned through less than a 90° arc before it interferes with part of the flat bed trailer and must be repositioned. Such a limited turn range is fine when the strapping 18 is taught. However, when the cargo is removed and the strapping 18 must be rewound into the winch, the limited turn range requires that several minutes be spent rewinding each winch. Since many flat bed trailers contain several winches on each side, a significant amount of time is required to rewind all of the winches. This results in much longer periods of time needed to load and unload flat bed trailers than would be necessary if the rewinding of the winches was not required or was expedited.

A need therefore exists in the art for a device that can reduce the amount of time required to rewind loose winch straps.

Such a need is met by the present invention device and method as described and claimed below.

SUMMARY OF THE INVENTION

The present invention is a hand crank device and associated method for winding winches such as those used on flat bed tractor trailers. Such winches have drive shafts with hollow open ends. A ring of holes is formed around the hollow end to enable a tightening bar to engage and turn the drive shaft. The present invention hand crank device is specifically designed to engage such a winch configuration. The hand crank device includes an elongated pin element that is sized to fit within any one of the holes that are disposed on the drive shaft. The pin element is long enough to enter through one hole on the drive shaft, extend across the drive shaft and exit the drive shaft through a second hole on the opposite side. The pin element is affixed to the short arm section of an L-shaped bracket. A handle is affixed to the long arm section of the L-shaped bracket, thereby enabling a torque to be applied to the L-shaped bracket and the pin element affixed to the L-shaped bracket. The torque acting on the pin element is transferred to the drive shaft of the winch, thereby causing the drive shaft to turn and the winch to rewind.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE PRESENT INVENTION

Although the present invention can be used with most any winch that must be manually rewound, the present invention is particularly well adapted for use with strap winches such as those commonly used to tie down cargo on flat bed trailers. As a result, the present invention will be described in an application where it engages a traditional flat bed trailer strap winch in order to set forth the best mode contemplated for the invention.

Figure 1:
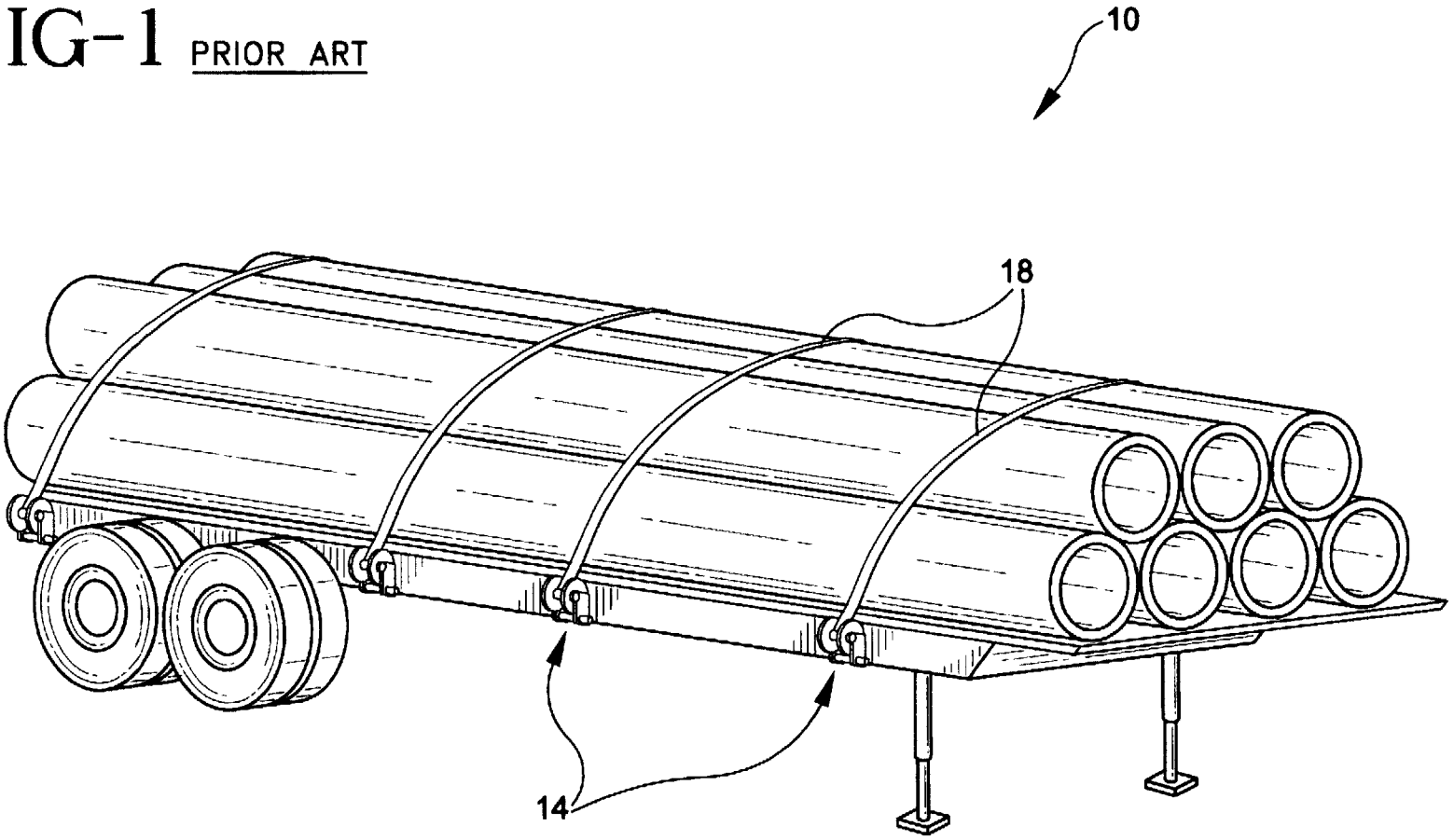
FIG-1 PRIOR ART
FIG. 1 is a perspective view of a typical prior art flat bed trailer having strap winches along both of its sides.
Figure 2:
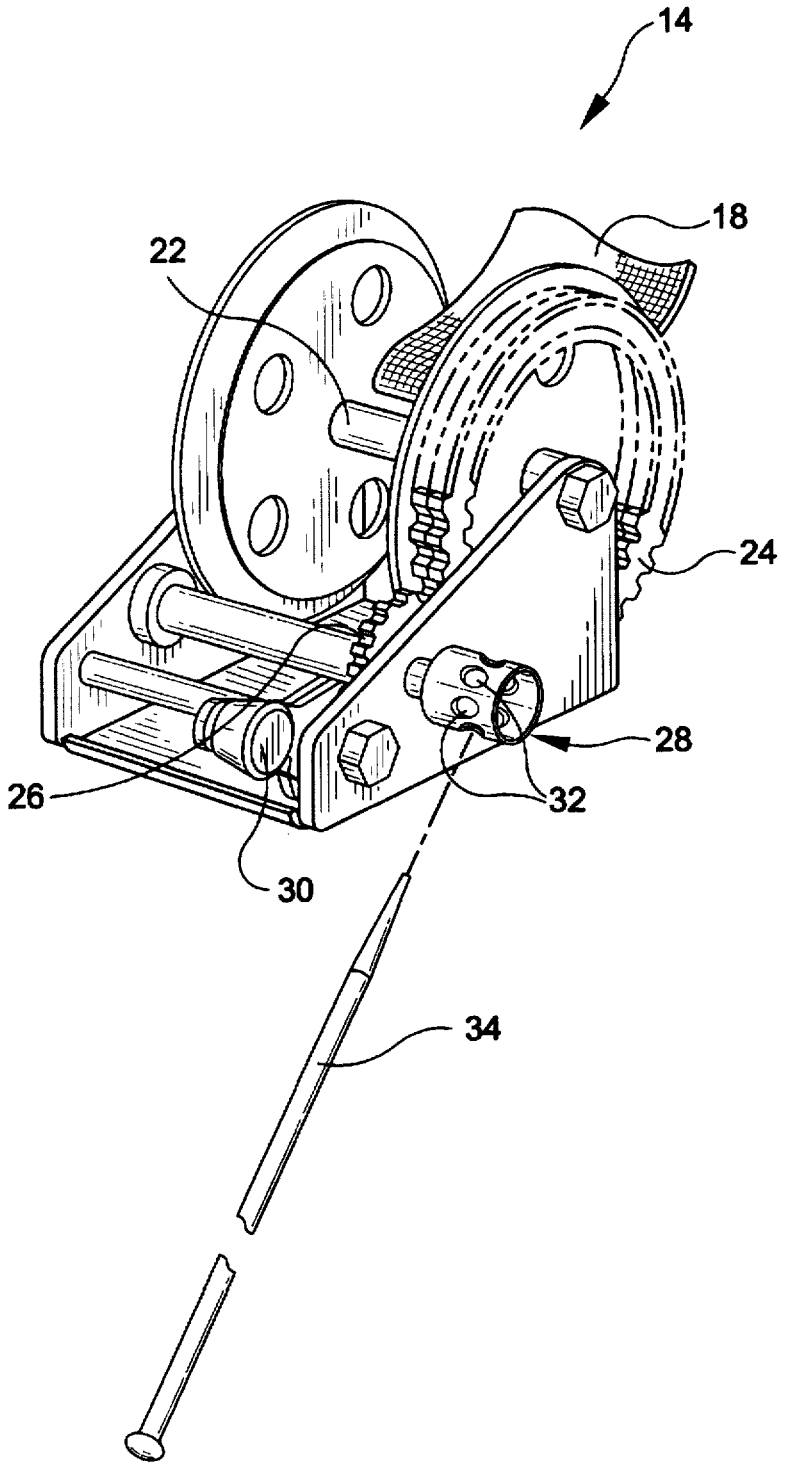
FIG. 2 shows perspective view of a typical prior art strap winch and a prior art tightening rod commonly used to tighten the strap winch.
Figure 3:
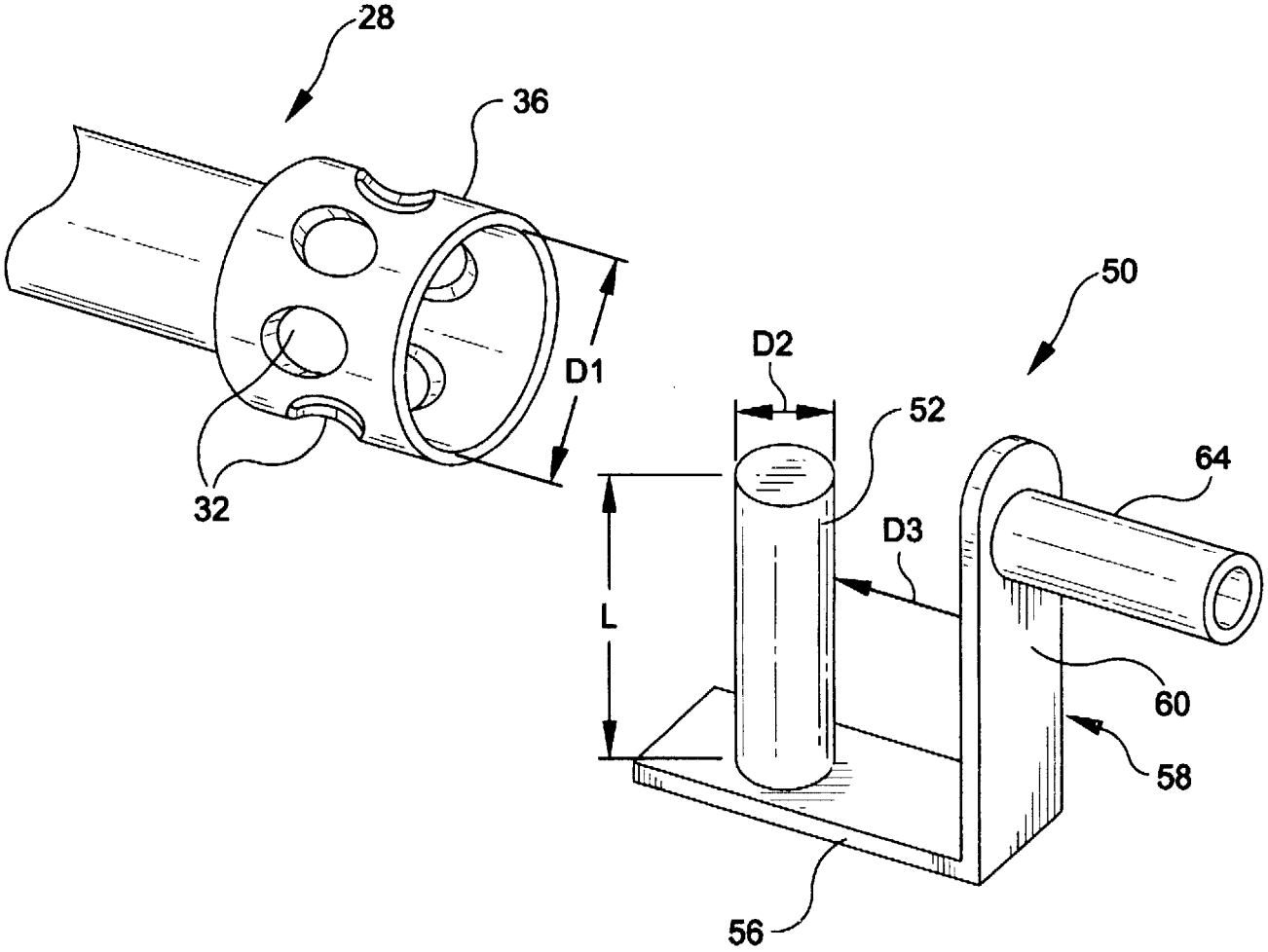
FIG. 3 shows a perspective view of one preferred embodiment of the present invention hand crank, shown in conjunction with the end of a prior art winch drive shaft.

Referring to FIG. 3, a hand crank device 50 is shown in accordance with the present invention. The hand crank device 50 is shown in conjunction with a typical strap winch drive shaft 28 having a hollow circular end 36 with an interior diameter D1. A ring of holes 32 is disposed around the drive shaft 28, wherein each of the holes 32 communicates with the hollow within the drive shaft 28. The hand crank device 50 contains a main pin element 52 that has an external diameter D2 that enables the pin element 52 to pass into any one of the holes 32 disposed around the drive shaft 28. The pin element 52 has a length L that enables the pin element 52 to extend into one of the holes 32, traverse the hollow in the center of the drive shaft 28 and pass through a second of the holes 32 on the opposite side of the drive shaft 28.

Figure 4:
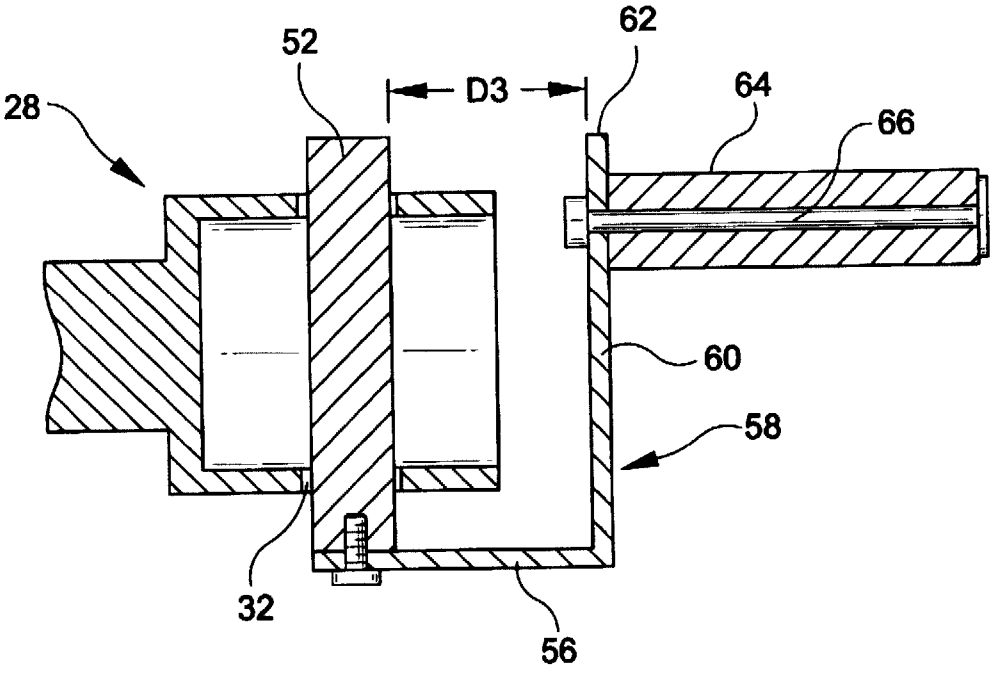
FIG. 4 shows a cross-sectional view of the embodiment shown in FIG. 3, wherein the present invention hand crank is engaging the prior art winch drive shaft.

Referring to FIG. 4 in conjunction with FIG. 3, it can be seen that the main pin element 52 is anchored at one end to the short leg section 56 of an L-shaped bracket 58. The short leg section 56 of the L-shaped bracket 58 extends in a plane that is perpendicular to the longitudinal axis of the main pin element 52. The long leg section 60 of the L-shaped bracket 58 extends along a line that is parallel to the main pin element 52, wherein the pin element 52 is separated from the long leg section 60 of the L-shaped bracket 58 by a distance D3. The distance D3 is longer than the distance between the holes 32 and the open end of the drive shaft 28, thereby ensuring that there is enough clearance for the hand crank device 50 to engage the drive shaft 52.

Although the pin element 52 and the L-shaped bracket 58 can be manufactured as a single piece unit, the pin element 52 is preferably a separate removable part. As is shown in FIG. 4, the pin element 52 bolts to the short leg region 56 of the L-shaped bracket 58. This enables the pin element 52 to be easily removed and replaced, should the pin element 52 become damaged or if a pin element of a different diameter is to be substituted.

Referring to FIG. 4, it can be seen that near the distal end 62 of the long leg section 60 of the L-shaped bracket 58 is disposed a handle 64. The handle 64 extends at a perpendicular to the longitudinal axis of the long leg section 60. The handle 64 is anchored to the L-shaped bracket 58. As a result, any torque applied to the handle 64 is transferred to the long arm section 60 of the L-shaped bracket 58. In the preferred embodiment, the handle 64 contains a central shaft 66 that affixes the handle 64 to the long arm section 60 of the L-shaped bracket 58. The handle is free to rotate around the central shaft 66, thereby enabling the handle 64 to freely rotate about its central axis.

To join the hand crank device 50 to the winch drive shaft 28, the person using the hand crank device 50 must first advance the main pin element 52 through two of the holes 32 disposed around the drive shaft 28. Once joined, a turning torque can be applied to the handle 64 of the hand crank device 50. The turning of the handle 64 causes the long arm section 60 of the L-shaped bracket 58 to turn, thereby applying a torque to the short arm section 56 of the L-shaped bracket 58. Since the short leg section 56 of the L-shaped bracket 58 is joined to the main pin element 52, the torque is transferred directly to the drive shaft 28 through the main pin element 52. This torque turns the drive shaft 28, thereby rewinding the winch driven by the drive shaft 28. The hand crank device 50 is sized so that it can be repeatedly turned a full 360° when positioned on the side of a flat bed tractor trailer. Consequently, the hand crank device 50 does not have to be repeatedly repositioned as the drive shaft 28 of a winch is turned. This enables the winch to be rapidly rewound. After the winch has been rewound, the main pin element 52 is removed from the holes 32 in the drive shaft 28. The same hand crank device can then be used on subsequent winches.

It will be understood that the embodiments of the present invention hand crank device and method illustrated and described above are merely exemplary and many variations and modifications can be made by using functionally equivalent components and/or alternate embodiments. For instance, it will be understood by a person skilled in the art that a large variety of pin element configurations can be used to engage the drive shaft of a winch. All such variations and modifications are intended to be included within the scope of the invention as defined by the appended claims.

What is claimed is:

1. A hand crank device for use in tightening a winch, said hand crank device comprising:

a first rigid element having a first end and a second end, wherein an aperture is disposed through said first rigid element proximate said first end;

a cylindrical pin having a top end, a bottom end, and a longitudinal axis, wherein a threaded bore is disposed in said bottom end of said cylindrical pin;

a bolt having a longitudinal axis, said bolt extending through said aperture in said first rigid element, wherein said bolt is received by said threaded bore in said bottom end of said cylindrical pin and attaches said cylindrical pin to said first rigid element in a fixed orientation, and wherein said longitudinal axis of said bolt is generally parallel to said longitudinal axis of said cylindrical pin;

a second rigid element coupled to said second end of said first rigid element, wherein a longitudinal axis of said second rigid element is generally parallel to said cylindrical pin and said second rigid element extends from said first rigid element in the same direction as said cylindrical pin; and a handle coupled to said second rigid element, wherein said handle has a mid-axis that is generally perpendicular to said longitudinal axis of said second rigid element and said handle is free to rotate about said mid-axis.

2. The device according to claim 1, wherein said rigid element and said cylindrical pin have the same general length.

3. The device according to claim 1, wherein said cylindrical pin, said first rigid element and said second rigid element are all straight.

4. The device according to claim 1, wherein said first rigid element and said second rigid element are unistructural parts of an L-shaped bracket.

5. The device according to claim 1, wherein said cylindrical pin is selectively detachable from said first rigid element.

* * * * *